US009268299B1

(12) United States Patent
Manning et al.

(10) Patent No.: US 9,268,299 B1
(45) Date of Patent: Feb. 23, 2016

(54) SYSTEMS AND METHODS FOR REMANUFACTURING IMAGING COMPONENTS

(71) Applicant: Static Control Components, Inc., Sanford, NC (US)

(72) Inventors: Rick Manning, Whispering Pines, NC (US); Thomas Mitchell, Spring Lake, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 14/637,624

(22) Filed: Mar. 4, 2015

(51) Int. Cl.
*G03G 15/00* (2006.01)
*G03G 21/18* (2006.01)

(52) U.S. Cl.
CPC ..... *G03G 21/181* (2013.01); *G03G 21/1817* (2013.01)

(58) Field of Classification Search
CPC ..... G03G 21/181; G03G 21/1817
USPC ..... 399/109
See application file for complete search history.

(56) References Cited

U.S. PATENT DOCUMENTS 7,477,864 B2 * 1/2009 Daniels ..... G03G 21/181 399/109
8,843,020 B2 * 9/2014 Huck ..... G03G 21/181 399/109

* cited by examiner

*Primary Examiner* — William J Royer

(57) ABSTRACT

Methods are provided for modifying an imaging process cartridge intended for installation in one type of printer to be installed in at least one other type of printer. In one embodiment, a method of modifying the imaging process cartridge may include modifying one or more endplates of the imaging process cartridge. In another embodiment, one or more of the endplates is removed and replaced with a replacement endplate.

11 Claims, 5 Drawing Sheets

SYSTEMS AND METHODS FOR REMANUFACTURING IMAGING COMPONENTS

TECHNICAL FIELD

The embodiments relate generally to remanufacturing and modifying imaging process cartridges, such as toner cartridges or imaging drum units, and more particularly to techniques for modifying an imaging process cartridge, such as a printer cartridge, that is intended to operate in one type or model of imaging device so that the imaging process cartridge will operate in additional types or models of imaging devices.

BACKGROUND

Printer cartridges are typically designed to provide a consumer with a certain number of print copies before the toner or ink is exhausted. The total number of print copies varies depending on the type, quality and density of the image provided by the printer. After all of the toner or ink is exhausted, the printer cartridges are either thrown away or recycled.

An industry has developed that facilitates the recycling of printer cartridges. Typically, a printer cartridge is recycled by a printer cartridge remanufacturer, who receives exhausted printer cartridges and refurbishes them. The refurbishment process entails replacing worn or nonfunctioning parts, refilling the printer cartridge with either toner or ink, and distributing the refurbished printer cartridges into the marketplace.

Toner cartridges are typically designed to fit into one type of laser printer or one family of laser printers. For example, the same toner cartridge may be used in a HP LaserJet Pro 100, HP LaserJet Pro 200, or a HP LaserJet Pro CP1025nw laser printer. As new printer models are introduced, a printer manufacturer may decide to alter physical characteristics of a respective toner cartridge that is used in older printer models. In some cases, the alteration may be an entirely new shape, or the printer manufacturer may only change a minor detail such as an indentation or a protrusion on the toner cartridge.

Additionally, different toner cartridges may be used within the same laser printer. These different toner cartridges may have very similar physical characteristics. For example, in a HP2500 color laser printer, there are four separate toner cartridges containing black and colored (magenta, cyan, and yellow) toner. The physical differences between the black, magenta, cyan, and yellow toner cartridges for the HP2500 color laser printer are relatively minor. The HP2500 color laser printer toner cartridge manufacturer has installed a protrusion in a unique location on one of the ends of each toner cartridge of a respective color to distinguish each toner cartridge of a respective color from toner cartridges of other colors. Each protrusion mates with a corresponding recess in the HP2500 color laser printer's toner cartridge space. When a respective toner cartridge is inserted into the HP2500 color laser printer, the protrusion aligns with the recess allowing only the designated toner cartridge to be installed.

A typical toner cartridge comprises an assembled plastic housing. The material of the plastic housing may be molded plastic or another plastic composite. During the remanufacturing of the toner cartridge, the toner cartridge is disassembled, cleaned, refurbished, and reassembled. The last step of the refurbishment process includes refilling the toner cartridge with toner, and the toner cartridge is then repackaged. As part of the refurbishment process, the toner cartridge may be modified in order to remove any restriction regarding usage.

Additionally, some laser printers separate a toner storage function from an image transfer function. In these laser printers, toner is stored in a toner cartridge, and an imaging drum unit performs the image transfer function. In some laser printers, the imaging drum unit may be a field replaceable unit. Typically, the imaging drum unit comprises an Organic Photo Conductor (OPC) drum as well as various image transfer components. The imaging drum unit may also have certain physical characteristics unique to a particular printer model type or family. For example, the imaging drum unit for the HP2500 color laser printer and HP2550 color laser printer may be identical except for a protrusion or recess located on the endplates of the imaging drum unit.

The systems and methods are intended for use in removing a protrusion on an endplate of a toner cartridge to allow the modified toner cartridge to be used in different locations within the same printer or other printers.

SUMMARY

The disclosed embodiments relate to systems and methods of modifying an imaging process cartridge to work in an imaging device other than an imaging device for which the imaging process cartridge was designed to work.

In one embodiment, the method includes providing an imaging process cartridge sized to be installed in a first type of imaging device and not sized to be installed in a second type of imaging device. The imaging process cartridge includes a drive side endplate, a contact side endplate, and a hopper. The drive side endplate includes a first external surface having a first channel thereon. The contact side endplate includes a second external surface having a second channel thereon. The method further includes modifying a shape of the first channel on the drive side endplate and modifying the shape of the second channel on the contact side endplate.

In another embodiment, a universal imaging process cartridge is sized to be installed in a first type of imaging device and in a second type of imaging device, and is not sized to be installed in a third type of imaging device. The universal imaging process cartridge includes a universal drive side endplate and a universal contact side endplate. The universal drive side endplate includes a first external surface having a first channel thereon. The contact side endplate includes a second external surface having at least a second channel thereon. The method further includes modifying a shape of the first channel on the drive side endplate and the second channel on the contact side endplate.

In another embodiment, a first drive side endplate that is sized to be installed in only a first type of imaging device is replaced with a second drive side endplate that is sized to be installed in a first type of imaging device and in a second type of imaging device. A shape of a first channel on the second drive side endplate is modified so that the second drive side endplate can be installed in a third type of imaging device.

In another embodiment, a first contact side endplate that is sized to be installed in only a first type of imaging device is replaced with a second contact side endplate that is sized to be installed in a first type of imaging device and in a second type of imaging device. A shape of a first channel on the second contact side endplate is modified so that the second contact side endplate can be installed in a third type of imaging device.

Those skilled in the art will appreciate the scope of the disclosure and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the disclosure, and together with the description serve to explain the principles of the disclosure.

DETAILED DESCRIPTION

Figure 1:
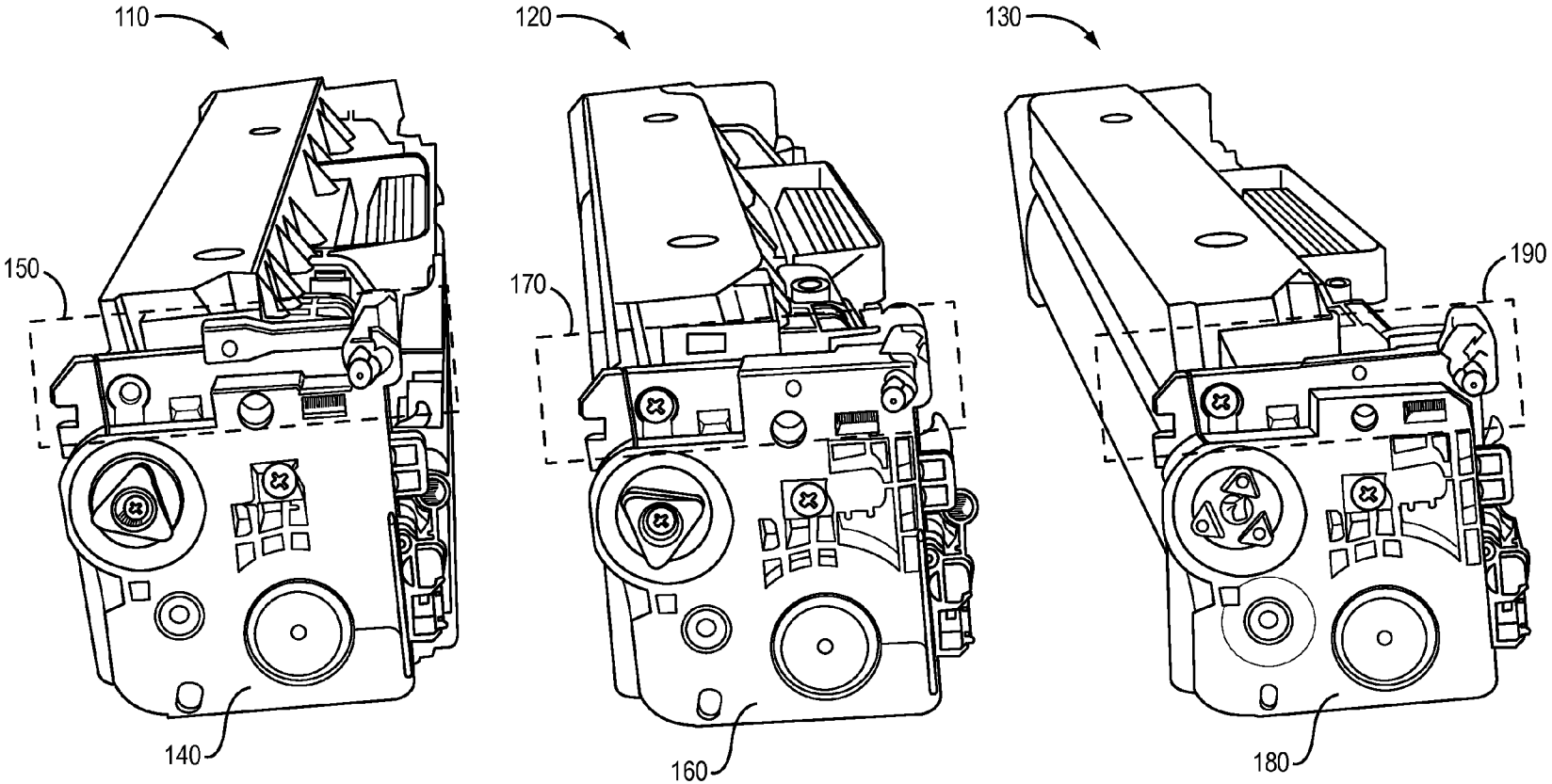
FIG. 1 is a view of drive side endplates for a HP CF380A toner cartridge, a HP CC530A toner cartridge, and a HP CE410A toner cartridge.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the embodiments are not limited to any particular sequence of steps. The use herein of ordinals in conjunction with an element is solely for distinguishing what might otherwise be similar or identical labels, such as "first drive side endplate" and "second drive side endplate," and does not imply a priority, a type, an importance, or other attribute, unless otherwise stated herein.

The following detailed description of preferred embodiments refers to the accompanying drawings, which illustrate specific embodiments of the invention. In the discussion that follows, specific systems and techniques for repairing, manufacturing, remanufacturing, and operating an imaging cartridge, such as a toner cartridge, are described. Other embodiments having different structures and operations for the repair, manufacture, remanufacture, and operation of other types of replaceable imaging components and for various types of imaging devices, such as laser printers, inkjet printers, copiers, facsimile machines and the like, do not depart from the scope of the invention.

The terms "provided" and "providing" are used only to signify that an item is obtained or present. The term "provided" is not used to imply that one party or entity "provides" an item to another party or entity.

Within the printer industry, printer manufacturers have employed various techniques to differentiate between toner cartridges and imaging drum units used in different printers. These techniques range from the obvious altering of the physical dimensions and shape of a toner cartridge or imaging drum unit to very subtle indentations or protrusions positioned at certain locations on the toner cartridge or the imaging drum unit. For example, some printer manufacturers have installed protrusions such as fins or keys that extend out from a printer's toner cartridge compartment and are positioned to fit inside a recess on a corresponding toner cartridge when the corresponding toner cartridge is installed inside the printer. In other printer types, this arrangement may be reversed. For example, a protrusion may exist on the toner cartridge, and the recess may exist inside the toner cartridge compartment inside the printer.

In color laser printers, multiple toner cartridges are typically installed. These printers have separate toner cartridges for black, cyan, magenta, and yellow toner. As is the case with the HP2500 color laser printer, the separate toner cartridges may be physically identical except for a key on each respective toner cartridge. The printer manufacturer typically provides the key to restrict the wrong toner cartridge from being installed in a particular toner cartridge location. In the HP2500 color laser printer for example, a key on a black toner cartridge restricts a black toner cartridge from being inserted into a location for a cyan toner cartridge.

Additionally, in color laser printers, two separate units may perform the toner storage and image transfer functions. In these color laser printers, a toner cartridge and separate imaging drum unit work together during the printing process. The toner cartridge acts only as a storage device, transferring toner to the imaging drum unit. The imaging drum unit transfers the toner from the various toner cartridges and fuses the toner to print media. In some color laser printers, the imaging drum unit may be removed and replaced as a unit. Printer manufacturers may extend the same keying concept to the imaging drum units, differentiating between imaging drum units of different printer types.

As new printer models are introduced, "new" toner cartridges or imaging drum units may also be introduced. In some cases, the new toner cartridge or new imaging drum unit may contain exactly the same components as those of the previous printer model. However, the new toner cartridge or new imaging drum unit may have slightly different physical packaging. In some cases, the printer manufacturer may install different keys, or keys in different locations. Changing the size, shape, orientation, or location of the keys allows the printer manufacturer to differentiate between previously introduced toner cartridges or imaging drum units and those of newer models. This may allow the printer manufacturer to increase his margins by charging the consumer a premium for the new toner cartridge or new imaging drum unit.

Printer manufacturers may take advantage of existing toner cartridge technology by using an existing toner cartridge or imaging drum unit design and making only slight physical packaging modifications. For example, the black toner cartridge for the HP2500 color laser printer may have exactly the same internal components and even use the same toner as the black toner cartridge for the HP2550 color laser printer. In this case, the only packaging difference between the two cartridges is the size, shape, location, and number of keys on the toner cartridge.

Similarly, the imaging drum unit of the HP2550 color laser printer has only slightly different physical packaging characteristics when compared to the imaging drum unit for the HP2500 color laser printer.

In the toner cartridge refurbishment industry, used toner cartridges and imaging drum units are collected and serviced by toner cartridge remanufacturers. The first step in the refurbishment process is the disassembly of the used toner cartridges. Next, the internal components are separated. Nonfunctioning components are replaced, and the remaining components, as well as the bodies of the toner cartridges, undergo a cleaning process. In the final step, the toner cartridges are reassembled, and new toner is added to the toner cartridges. The refurbished toner cartridges are then packaged and distributed to the consumer.

Part of the refurbishment process may include making physical alterations to a toner cartridge or imaging drum unit. For example, an older toner cartridge that operates in a first type of laser printer may be altered or converted to a toner cartridge that operates in a second type of laser printer. Alternatively, a remanufacturer may remove all of the keys on a toner cartridge, thus creating a "universal" toner cartridge that may be used in all locations within a respective printer type or across multiple printer types. The invention provides a way of converting a toner cartridge of one type into another.

Currently, a HP CE410A toner cartridge is very similar to a newer model HP CC530A toner cartridge and a HP CF380A toner cartridge. The HP CE410A toner cartridge may be modified on a drive side endplate and on a contact side endplate to properly fit and operate in a HP CC530A printer and in a HP CF380A printer. The drive side endplate is the endplate of a toner cartridge on a side that is driven by the printer to cause rotation of a developer roller located within the toner cartridge. The contact side endplate is the endplate of a toner cartridge on a side that contacts an interior of the printer. Similarly, the HP CC530A toner cartridge may be modified on the drive side endplate and on the contact side endplate to fit and operate in a HP CE410A printer and in a HP CF380A printer. Alternatively, the drive side endplate may be removed from either a HP CE410A toner cartridge or a HP CC530A toner cartridge and replaced with a universal drive side endplate that will properly fit in the HP CE410A printer, the HP CC530A printer, and the HP CF380A printer. These modifications will be described in more detail below.

FIG. 1 shows a view of drive side endplates for a HP CF380A toner cartridge 110, a HP CC530A toner cartridge 120, and a HP CE410A toner cartridge 130. The HP CF380A toner cartridge 110 has a first drive side endplate 140 having a first channel 150 in a surface thereon. The HP CC530A toner cartridge 120 has a second drive side endplate 160 having a second channel 170 in a surface thereon. The HP CE410A toner cartridge 130 has a third drive side endplate 180 having a third channel 190 in a surface thereon. The size and shape of the third channel 190 prevents the HP CE410A toner cartridge 130 from installing properly in a HP CC530A printer and a HP CF380A printer. The size and shape of the second channel 170 prevents the HP CC530A toner cartridge 120 from installing properly in a HP CF380A printer and a HP CE410A printer. In order to allow the HP CE410A toner cartridge 130 to properly install in a HP CC530A printer or a HP CF380A printer, the shape of the third channel 190 is modified in order to remove portions that prevent the third drive side endplate 180 from properly installing in a HP CC530A printer or a HP CF380A printer. Modifying the third channel 190 may be done by cutting, trimming, drilling, or any other suitable technique to modify the shape of a plastic part.

Similarly, in order to allow the HP CC530A toner cartridge 120 to properly install in a HP CE410A printer or a HP CF380A printer, the shape of the second channel 170 is modified in order to remove portions that prevent the second drive side endplate 160 from properly installing in a HP CE410A printer or a HP CF380A printer. Modifying the second channel 170 may be done by cutting, trimming, drilling, or any other suitable technique to modify the shape of a plastic part.

Figure 2:
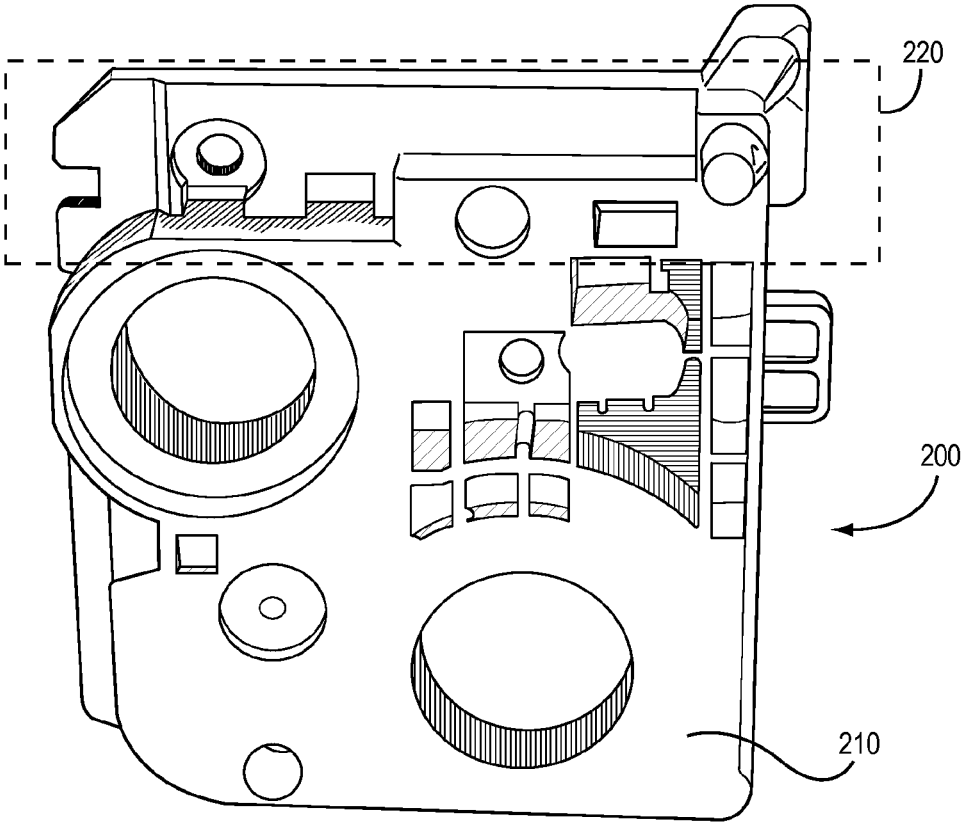
FIG. 2 is a view of a universal drive side endplate.

In another embodiment, the second drive side endplate 160 or the third drive side endplate 180 is removed and replaced with a universal drive side endplate 200, a view of which is shown in FIG. 2. The universal drive side endplate 200 has a first surface 210 having a channel 220 thereon. The channel 220 is shaped so that a toner cartridge having the universal drive side endplate 200 will properly install in a HP CF380A printer, a HP CC530A printer, and a HP CE410A printer. Replacing the second drive side endplate 160 on the HP CC530A toner cartridge 120 with the universal drive side endplate 200 will allow the universal drive side endplate 200 to properly fit and function in all three printer types. Also, replacing the third drive side endplate 180 on the HP CE410A toner cartridge 130 with the universal drive side endplate 200 will allow the universal drive side endplate 200 to properly fit and function in all three printer types.

Figure 3:
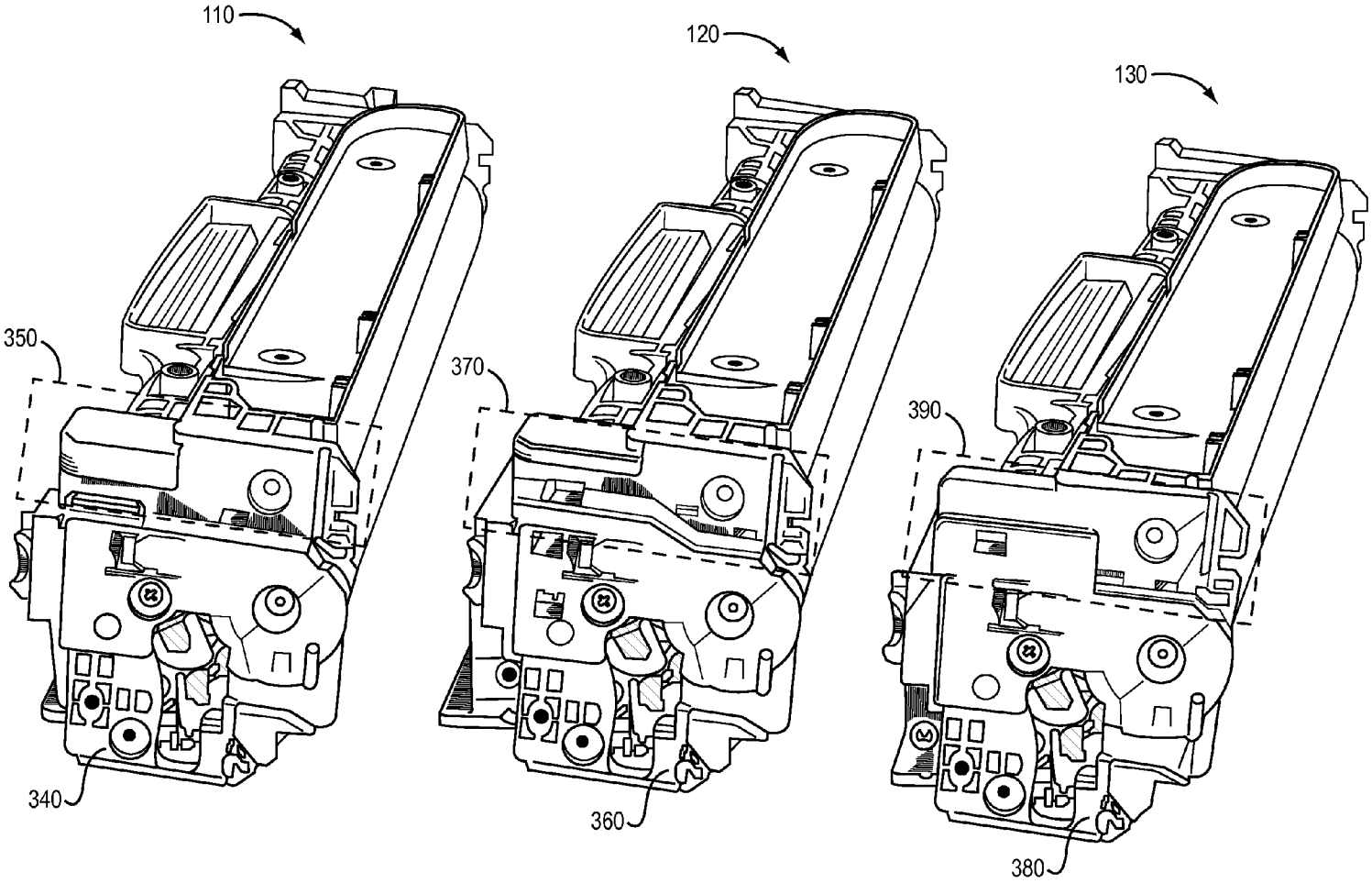
FIG. 3 is a view of contact side endplates for a HP CF380A toner cartridge, a HP CC530A toner cartridge, and a HP CE410A toner cartridge.

FIG. 3 shows a view of contact side endplates for a HP CF380A toner cartridge 110, a HP CC530A toner cartridge 120, and a HP CE410A toner cartridge 130. The HP CF380A toner cartridge 110 has a first contact side endplate 340 having a first channel 350 on a surface thereon. The HP CC530A toner cartridge 120 has a second contact side endplate 360 having a second channel 370 on a surface thereon. The HP CE410A toner cartridge 130 has a third contact side endplate 380 having a third channel 390 on a surface thereon. The size and shape of the third channel 390 prevents the HP CE410A toner cartridge 130 from installing properly in a HP CC530A printer and a HP CF380A printer. The size and shape of the second channel 370 prevents the HP CC530A toner cartridge 120 from installing properly in a HP CF380A printer and a HP CE410A printer. In order to allow the HP CE410A toner cartridge 130 to properly install in a HP CC530A printer or a HP CF380A printer, the shape of the third channel 390 is modified in order to remove portions that prevent the third contact side endplate 380 from properly installing in a HP CC530A printer or a HP CF380A printer. Modifying the third channel 390 may be done by cutting, trimming, drilling, or any other suitable technique to modify the shape of a plastic part.

Similarly, in order to allow the HP CC530A toner cartridge 120 to properly install in a HP CE410A printer or a HP CF380A printer, the shape of the second channel 370 is modified in order to remove portions that prevent the second contact side endplate 360 from properly installing in a HP CE410A printer or a HP CF380A printer. Modifying the second channel may be done by cutting, trimming, drilling, or any other suitable technique to modify the shape of a plastic part.

Figure 4:
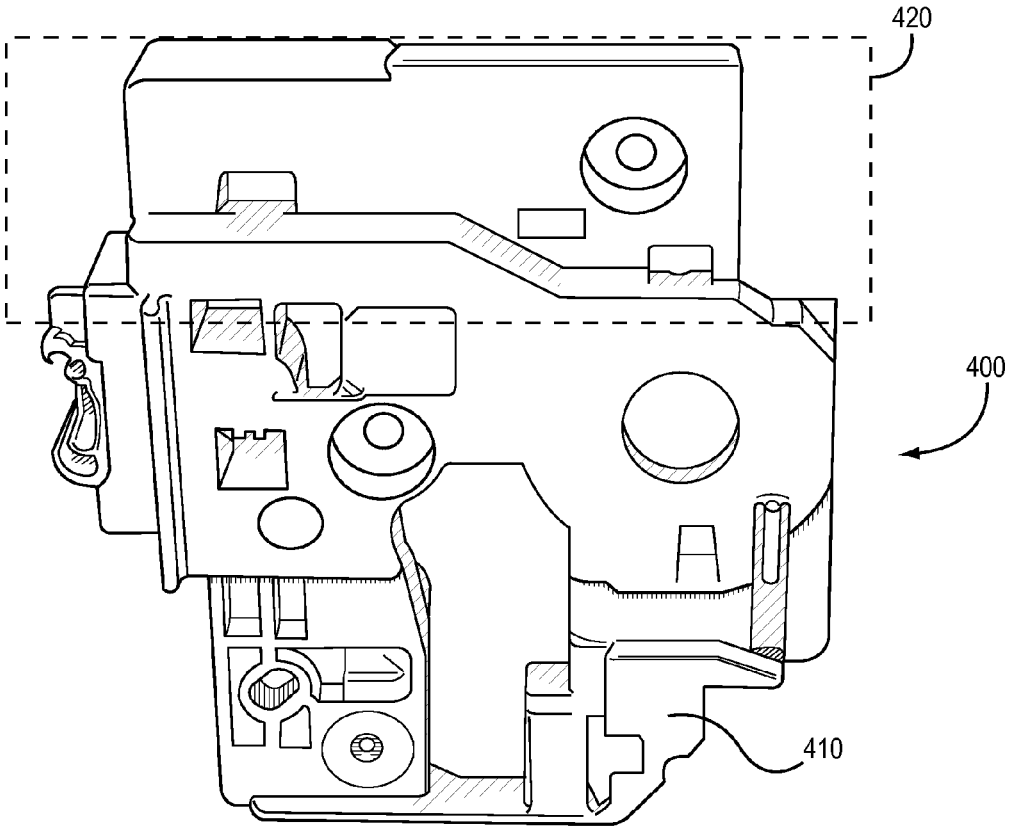
FIG. 4 is a view of a universal contact side endplate.

In another embodiment, the second contact side endplate 360 or the third contact side endplate 380 is removed and replaced with a universal contact side endplate 400, a view of which is shown in FIG. 4. The universal contact side endplate 400 has a first surface 410 having a channel 420 thereon. The channel 420 is shaped so that a toner cartridge having the universal contact side endplate 400 will properly install in a HP CF380A printer, a HP CC530A printer, and a HP CE410A printer. Replacing the second contact side endplate 360 on the HP CC530A toner cartridge 120 with the universal contact side endplate 400 will allow the universal contact side endplate 400 to properly fit and function in all three printer types. Also, replacing the third contact side endplate 380 on the HP CE410A toner cartridge 130 with the universal contact side endplate 400 will allow the universal contact side endplate 400 to properly fit and function in all three printer types.

Figure 5:
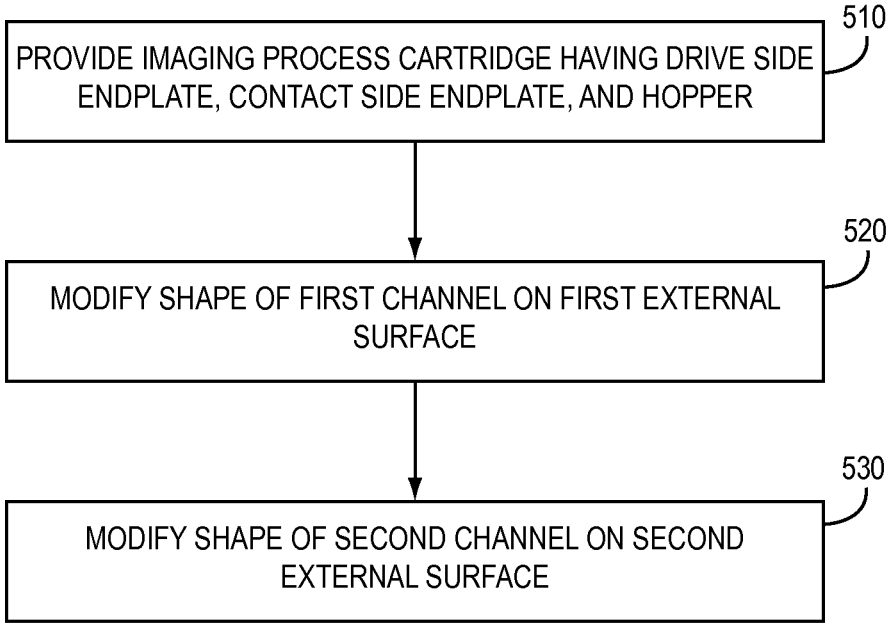
FIG. 5 is a flowchart describing a method of modifying a toner cartridge.

FIG. 5 is a flowchart describing a method of modifying a toner cartridge so that the toner cartridge will properly fit and function in a HP CE410A printer, a HP CC530A printer, and a HP CF380A printer. The method includes providing an imaging process cartridge having a drive side endplate, a contact side endplate, and a hopper (step 510). The drive side endplate comprises a first external surface and a first channel on the first external surface. The contact side endplate comprises a second external surface and a second channel on the second external surface. A shape of the first channel on the first external surface is modified (step 520). A shape of the second channel on the second external surface is modified (step 530).

Within a toner cartridge or imaging drum unit, an electronic identification chip may be installed. The identification chip may contain information relating to the printer type, printer manufacturer, amount of toner contained in the toner cartridge, and so forth. Even if the physical restrictions between cartridge types have been removed, the electronic identification chip may need to be replaced in order to allow the toner cartridge or imaging drum unit to function properly in its new location or printer.

Those skilled in the art will recognize improvements and modifications to the embodiments of the disclosure. All such improvements and modifications are considered within the scope of the concepts disclosed herein and the claims that follow.

What is claimed is:

1. A method of modifying an imaging process cartridge, the imaging process cartridge sized to be installed in a first type of imaging device and not sized to be installed in a second type of imaging device, the method comprising:

providing the imaging process cartridge, the imaging process cartridge further comprising a drive side endplate, a contact side endplate, and a hopper, wherein the drive side endplate comprises a first external surface and a first channel on the first external surface, and wherein the contact side endplate comprises a second external surface and a second channel on the second external surface;

modifying a shape of the first channel on the first external surface; and modifying a shape of the second channel on the second external surface.

2. The method of claim 1, wherein modifying the shape of the first channel includes enlarging at least a portion of the first channel.

3. The method of claim 2, wherein enlarging the at least the portion of the first channel comprises cutting or trimming a portion of the first external surface.

4. The method of claim 1, wherein modifying the shape of the second channel includes enlarging at least a portion of the second channel.

5. The method of claim 4, wherein enlarging the at least the portion of the second channel comprises cutting or trimming a portion of the second external surface.

6. The method of claim 1, wherein modifying the shape of the first channel on the first external surface comprises removing the drive side endplate, providing a universal drive side endplate, and attaching the universal drive side endplate to an end of the imaging process cartridge.

7. The method of claim 1, wherein modifying the shape of the second channel on the second external surface comprises removing the contact side endplate, providing a universal contact side endplate, and attaching the universal contact side endplate to an end of the imaging process cartridge.

8. The method of claim 1, wherein the imaging process cartridge is an imaging process cartridge designed to work in a HP CC530A imaging device and modifying the imaging process cartridge enables the imaging process cartridge to fit and function in a HP CE410A imaging device or an HP CF380A imaging device.

9. The method of claim 1, wherein the imaging process cartridge is an imaging process cartridge designed to work in a HP CE410A imaging device and modifying the imaging process cartridge enables the imaging process cartridge to fit and function in a HP CC530A imaging device or an HP CF380A imaging device.

10. A replacement universal imaging process cartridge that is sized to be installed in a first type of imaging device, sized to be installed in a second type of imaging device, and sized to be installed in a third type of imaging device, wherein a first cartridge is sized to be installed in the first type of imaging device and is not sized to be installed in the second type of imaging device or the third type of imaging device, and wherein a second cartridge is sized to be installed in the second type of image device and is not sized to be installed in the first type of imaging device or the third type of imaging device, the replacement universal imaging process cartridge comprising:

a universal drive side endplate, wherein the universal drive side endplate is sized to be installed in the first type of imaging device, the second type of imaging device, and the third type of imaging device; and a universal contact side endplate, wherein the universal contact side endplate is sized to be installed in the first type of imaging device, the second type of imaging device, and the third type of imaging device.

11. The replacement universal imaging process cartridge of claim 10, wherein the first type of imaging device is a HP CE410A imaging device, the second type of imaging device is a HP CC530A imaging device, and the third type of imaging device is a HP CF380A imaging device.

* * * * *